US010094119B2

(12) United States Patent
Morelli

(10) Patent No.: US 10,094,119 B2
(45) Date of Patent: Oct. 9, 2018

(54) ROOF RAFTER THERMAL BREAK SYSTEM

(71) Applicant: Jonas Morelli, Averill Park, NY (US)

(72) Inventor: Jonas Morelli, Averill Park, NY (US)

( * ) Notice: Subject to any disclaimer, the term of this patent is extended or adjusted under 35 U.S.C. 154(b) by 0 days.

(21) Appl. No.: 15/491,754

(22) Filed: Apr. 19, 2017

(65) Prior Publication Data

US 2017/0298632 A1 Oct. 19, 2017

Related U.S. Application Data

(60) Provisional application No. 62/324,672, filed on Apr. 19, 2016.

(51) Int. Cl.
*E04D 13/16* (2006.01)
*E04D 13/17* (2006.01)

(52) U.S. Cl.
CPC ..... *E04D 13/1612* (2013.01); *E04D 13/172* (2013.01); *E04D 13/178* (2013.01)

(58) Field of Classification Search
CPC . E04D 13/172; E04D 13/178; E04D 13/1612; E04B 7/18
See application file for complete search history.

(56) References Cited

U.S. PATENT DOCUMENTS 5,094,054 A * 3/1992 Arends ..... E04D 13/178 454/260
5,596,847 A * 1/1997 Stephenson ..... E04D 13/172 52/198
5,600,928 A * 2/1997 Hess ..... E04C 2/322 428/158
6,061,973 A * 5/2000 Accardi ..... E04D 13/17 52/199
6,357,185 B1 * 3/2002 Obermeyer ..... E04D 13/152 52/302.1
7,142,551 B2 11/2006 Barrack et al.
7,302,776 B2 12/2007 Duncan et al.
7,861,467 B2 * 1/2011 Rosten ..... E04D 13/178 52/198
8,137,170 B2 * 3/2012 Klement ..... E04D 13/178 126/621
2005/0072072 A1 * 4/2005 Duncan ..... E04D 13/17 52/198
2006/0218869 A1 * 10/2006 Ellis ..... E04D 13/1618 52/309.9

* cited by examiner

*Primary Examiner* — Beth A Stephan
(74) *Attorney, Agent, or Firm* — Heslin Rothenberg Farley & Mesiti P.C.; Victor A. Cardona, Esq.

(57) ABSTRACT

A roof system includes a roof deck and a plurality of roof rafters supporting the roof deck. A thermal break is located between the deck and a first rafter of the plurality of rafters. The thermal break includes a break inner member contacting a first rafter exterior surface of the first rafter and a break outer member contacting a deck inner surface of the roof deck. The break inner member and the break outer member bound a thermal air break therebetween.

20 Claims, 3 Drawing Sheets

ROOF RAFTER THERMAL BREAK SYSTEM

CROSS-REFERENCE TO RELATED APPLICATION

This application claims priority to U.S. Provisional Application No. 62/324,672 filed on Apr. 19, 2016, the entire disclosure of which is incorporated herein by reference.

TECHNICAL FIELD

The present invention relates, generally, to methods and apparatus for building construction, particularly, to systems and methods for providing a thermal barrier to a roofing system.

BACKGROUND OF THE INVENTION

Conventional wood framed buildings, such as residential dwellings, often include a wood-framed roof and an attic between such roof and ceiling joists of a ceiling of an upper floor of the building. In another example, a conventional attic may not be present and a cathedral type ceiling may be utilized where a ceiling is connected to roof rafters instead of a ceiling being aligned horizontally with an attic above such ceiling. It is desirable to minimize heat loss through the roof of such buildings through the use of insulation and other energy efficiency measures. By minimizing such heat loss the cost of heating and the carbon footprint of a building may be minimized.

In a conventional, wood-framed roof, a roof deck (e.g., plywood) may have shingles and other water resistant materials on an outer surface thereof and a bottom surface of the deck may be connected to roof rafters. In the case of a cathedral type ceiling, insulation (e.g., fiberglass insulation) and rafter bay baffles may be located in rafter bays between the rafters and connected to an underside of the roof deck to minimize heat loss through the roof deck.

In one example, a thermal resistance (R-value) of a 2×10 rafter is approximately R11 and for a 2×12, this may be R14. The thermal resistance of such a rafter is low for insulated roofs when compared to R-values of conventional fiberglass insulation, which ranges from around R30 installed in 2×10 rafter bays to R38 for 2×12 rafter bays. This difference may result in non-uniform heat transfer through the roof deck. Essentially, more heat will be transferred through the area in which the rafter comes in contact with the roof deck, than will be transferred through an equal area of contact between the insulated rafter bay and the roof deck. Such non-uniform heat transfer could result in non-uniform ice-melts and formation of potentially damaging ice dams.

Additionally, properly insulated rafter bays have an air space below the roof deck and above the insulation to allow for air ventilation flow between soffit and ridge vents. This air space does not extend to the area between the roof deck and the supporting rafters, exacerbating the non-uniformity in thermal resistance between the locations of the rafters and the insulated rafter bays. The presence of an air layer below the roof deck and above the insulation in the rafter bays may significantly reduce conductive heat transfer between the insulation material and the roof deck in the rafter bay areas, but have little or no effect on heat transfer in the area of contact between the rafter and the roof deck.

Thus, there is a need for systems and methods for use in increasing a thermal barrier of a roof system.

SUMMARY OF THE INVENTION

The present invention provides, in a first aspect, a roof system which includes a roof deck, a plurality of roof rafters supporting the roof deck, and a thermal break between the roof deck and a first rafter of the plurality of rafters. The thermal break includes a break inner member contacting a first rafter exterior surface of the first rafter and a break outer member bound a thermal air break therebetween.

The present invention provides, in a second aspect, a method for use in constructing a roof system which includes locating a thermal break between a roof deck and a first rafter of a plurality of rafters configured to support the roof. A break inner member of the thermal break contacts a first rafter exterior surface of the first rafter. A break outer member of the thermal break contacts a deck inner surface of the roof deck and the break inner member and break outer member bound a thermal air break therebetween.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF THE INVENTION

Figure 1:
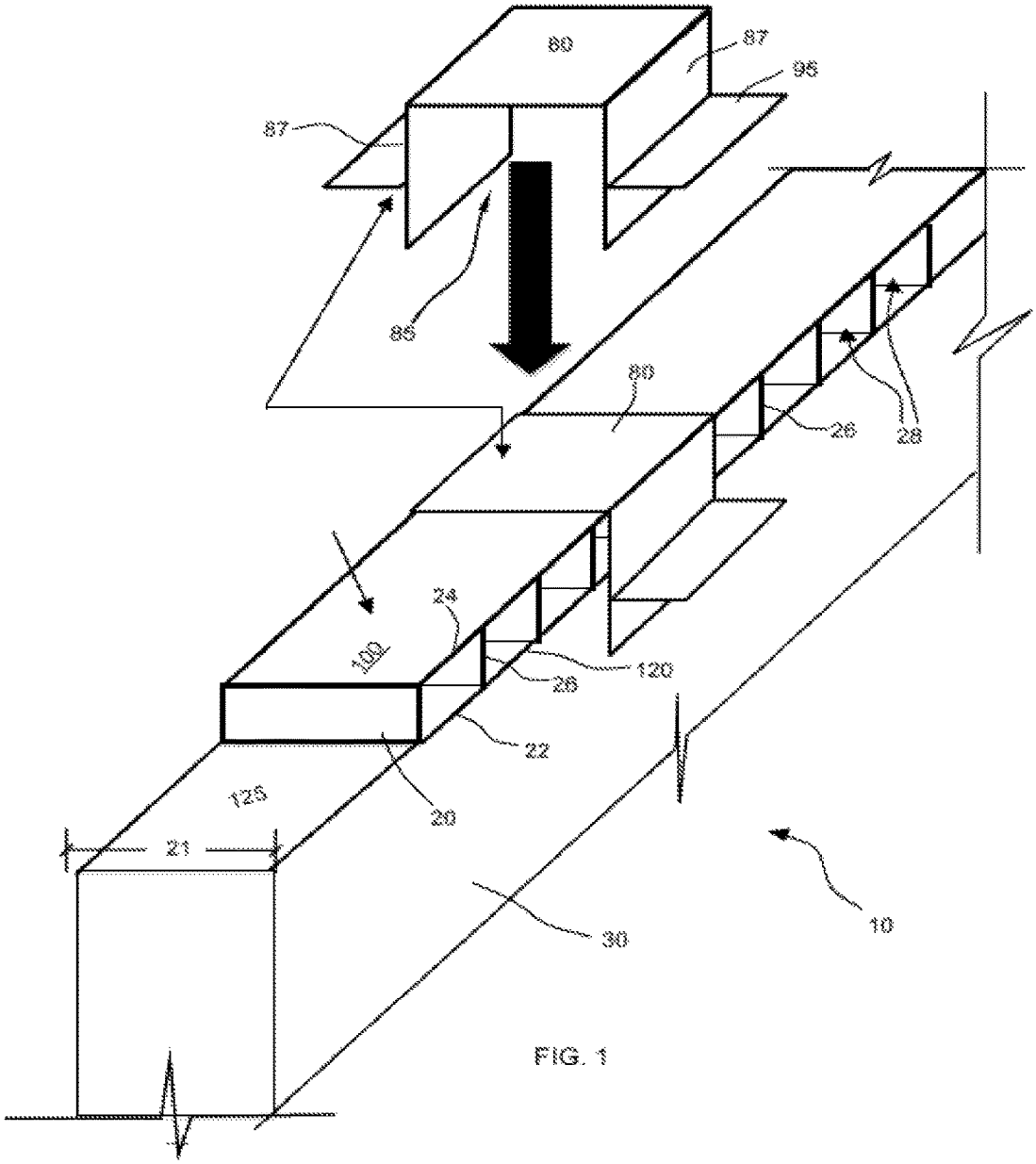
FIG. 1 is a perspective view a baffle holder being attached to a thermal break and a rafter of a roof system in accordance with the present invention.

In accordance with the principals of the present invention, system and methods for constructing a roof system including increasing a thermal barrier of a roof system are provided.

In an exemplary embodiment depicted in FIGS. 1-4, a roof system 10 includes a thermal break 20 located between a first roof rafter 30 of a plurality of roof rafters 35 and a roof deck 45.

Roof deck 45 may include a structural roof portion (e.g., plywood, particle board) and waterproofing materials such as tar paper and shingles. Rafters 35 are connected to an upper ceiling joist or another part of an upper portion of a structure, such as a single residential home or other structure framed with wood, metal or other dimensional building materials. A ceiling may be connected to a bottom side of the rafters with a bottom side facing a living space of the structure, such as a home with a cathedral type ceiling.

Thermal break 20 may include a break inner member 22 and a break outer member 24 extending parallel to each other longitudinally such that thermal break 20 may extend along one of rafters 35. Break inner member 22 and break outer member 24 are separated from each other by a plurality of break supports 26 and a plurality of spaces 28. Opposite ends of break supports 26 may be connected to break inner member 22 and break outer member 24. Thermal break 20 may also be formed monolithically such that break supports 26, break inner member 22 and break outer member 24 are formed of same material via molding, 3D printing or another method that allows one-piece formation.

Spaces 28 may be bounded by inner surfaces of break inner member 22, break outer member 24 and opposing surfaces of opposing break supports 26.

Figure 2:
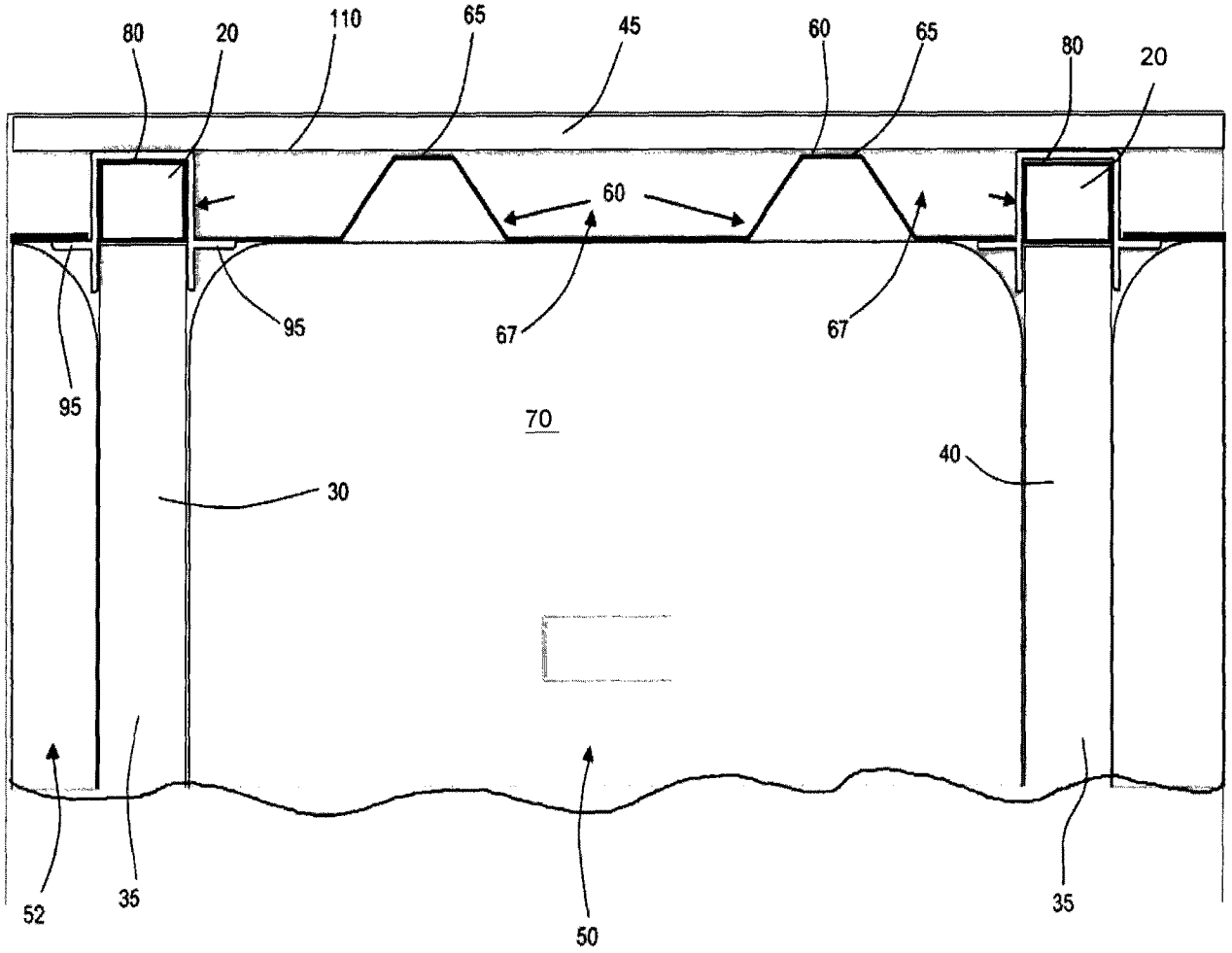
FIG. 2 is a side cross sectional view of the roof system of FIG. 1 depicting a baffle in a rafter bay between a pair of roof rafters.

Thermal break 20 may have a width dimension 21 about equal to a thickness (e.g., 1.5 in.) of one of rafters 35 (e.g., rafter 30) as depicted in FIGS. 1-2, for example. Thermal break 20 may extend over all or part of longitudinal dimensions of each of rafters 35 such that thermal break 20 may be supported by rafters 30 and thermal break 20 may support roof deck 45.

Figure 3:
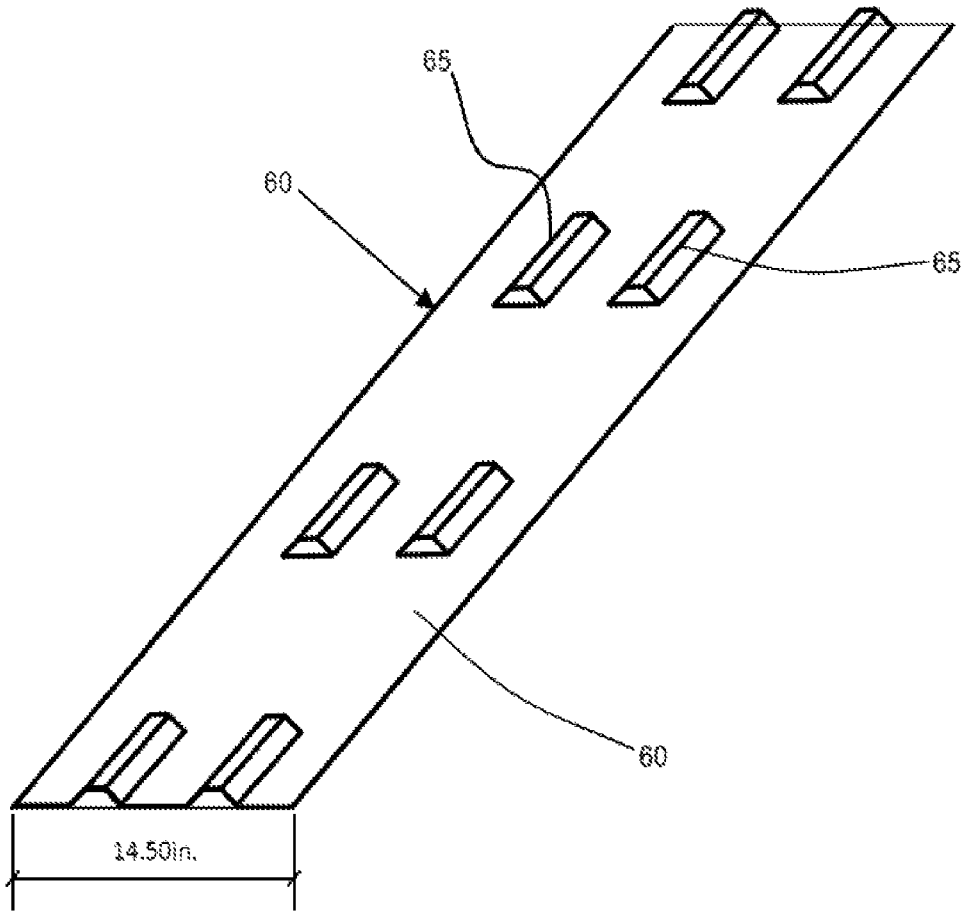
FIG. 3 is a perspective view of the baffle of FIG. 2 shown separated from the roof system.

A rafter bay 50 may be located between rafter 30 and a rafter 40. A rafter bay baffle 60 may be located between roof deck 45 and an insulation layer 70 in rafter bay 50. Baffle 60 may include projections 65 spaced longitudinally and transversely relative to a longitudinal direction thereof as depicted in FIG. 3, for example. Spaces 67 may be located around projections 65 to allow a flow of air in rafter bay 50 beneath roof deck 45 and above insulation layer 70. Spaces 67 may be about 0.75" to 1.0" in a direction perpendicular to a plane of roof deck 45 when rafters 30 are formed of dimensional lumber of 2×8, 2×10, 2×12, for example. When rafters are separated by 16 inches on center (i.e., at center longitudinal portions thereof) two projections 65 may be present as depicted in FIG. 3 and a baffle (e.g., baffle 60) may be 14.5 inches wide while at other separations (e.g., 24 inches on center) different numbers of projections (e.g., three) may be present. Rafter bay baffle 60 may be formed of dimpled plastic foam or other lightweight material.

A baffle holder 80 may be attached to thermal break 20 and/or one of rafters 35 (e.g., rafter 30) as depicted in FIGS. 1-2, for example. Holder may include a cavity 85 bounded by two vertical legs 87 and a top 90 aligned substantially perpendicularly to the legs. Cavity 85 may be configured (e.g., shaped and dimensioned) to receive a rafter (e.g., rafter 30) therein such that holder 80 may fit over break 20 and the rafter. Holder 80 may be connected to thermal break 20 and/or rafter 30 via standard construction fasteners (e.g., nails, screws, staples, adhesive), or a pressure fit or friction fit, for example. Baffle holder 80 may include arms 95 extending outwardly into opposite rafter bays about perpendicularly to legs 87 to allow holder 80 to hold baffle 60 in a rafter bay (e.g., rafter bay 50) such that spaces 67 allow air flow therethrough as described above. Multiple such holders (e.g., holder 80) may be used along a longitudinal dimension of rafters (e.g., rafters 30, 40) bounding a rafter bay (e.g., bay 50) receiving a baffle (e.g., baffle 60) between a roof deck (e.g., deck 45) and an insulation layer (e.g., insulation layer 70). Such holders may be mounted to the rafters by pressure-fit, adhesive, or mechanical means as indicated above.

Also, each holder (e.g., holder 80) may be 1.5 inches long in a linear direction along a longitudinal direction of a rafter and such holders may be spaced one per linear foot along each rafter, for example. The holders may be also formed in various other lengths and may be made of plastic, such as ABS, polyethylene, or an extruded plastic, for example. Each holder may have a same or slightly larger width dimension than a width dimension (e.g., 1.5 inches) of a thermal break as depicted in FIG. 1, for example. As depicted, legs (e.g., legs 87) of the holders may extend below a bottom surface of the thermal break while the arms (e.g., arms 95) may extend from about 1.5 inches below the top of the thermal break (or around the top of the rafter) laterally into the rafter bays. Each arm may also be about 1.5 inches by 1.5 inches in a plane parallel to a top of the thermal break as depicted, for example.

In an example, when thermal break 20 is connected to rafter 30 via holder 80 or otherwise, an outer surface 100 of break outer member 24 may contact an inner surface 110 of roof deck 45 while an inner surface 120 of break inner member 22 may contact an outer surface 125 of rafter 30 such that spaces 28, break outer member 24, and break inner member 22 separate inner surface 110 from outer surface 125 with such a separation providing a thermal break or heat transfer resistance between rafter 30 and roof deck 45. The heat transfer resistance may inhibit non-uniform heat transfer to and from the roof deck to provide a reduction in concentrated, conductive heat transfer through the roof deck (e.g., sheathing, plywood, etc.) that would otherwise occur as a result of direct contact between the roof deck (e.g., roof deck 45) and the supporting wood rafters (e.g., rafter 30) in conventional construction. By inhibiting such heat transfer from an interior of a dwelling or other heated structure toward an ambient environment non-uniform ice-melts and formation of potentially damaging ice dams may be minimized. An additional thickness of a rafter structure due to the added thickness of the thermal break may provide an increased volume in rafter bays (e.g., rafter bay 50) between such rafters (e.g., rafters 35) which may provide more space for insulation material which may minimize any loss of thermal resistance that may otherwise be caused by a compression of insulating materials which sometimes occurs when insulation is compressed to fit into a particular volume. In another example, increased insulation could be utilized due to the increased volume in such a rafter bay which would result in an increased R value.

As indicated, holder 80 may be attached to break 20 and/or a rafter of rafters 35 to provide an air space (e.g., spaces 67) between roof deck 45 and insulation layer 70. Thermal break 20 may also be aligned such that spaces 28 thereof allow air flow from a rafter bay located on each side of the rafter to which the thermal break may be attached. For example, thermal break 20 may be attached to rafter 30 such that supports 26 have longitudinal dimensions aligned perpendicularly relative to a longitudinal dimension of rafter 30 to allow air flow from spaces 67 of rafter bay 50 through spaces 28 to a rafter bay 52 on an opposite side of rafter 30.

As indicated, air flow between rafter bays due to an alignment of supports 26 to allow such air flow through spaces 28 allows lateral movement of ventilation air across an entire underside of a roof area (e.g., roof deck 45), which may reduce or eliminate zones of concentrated, conductive heat transfer through the roof deck, and the problems associated with non-uniform heat transfer through the roof deck that occurs as a result of direct contact between the roof deck and the supporting wood rafters.

In an example, thermal break 20 may be formed of or fluted plastic or fiberglass or another material which is rated for between 70 and 100 pounds continuous load per square foot of surface area. The material forming thermal break 20 may be capable of continuous operation without significant softening and/or deformation between −30° F. and 180° F. and able to withstand nailing without cracking or significant reduction in other levels of performance. Thermal break 20 may have a thickness dimension of between 0.5 in. and 1.0 in. thick, or otherwise corresponding with a thickness of an air space above the insulation in a rafter bay as described above.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A roof system comprising:

a roof deck;

a plurality of roof rafters supporting said roof deck;

a thermal break between the deck and a first rafter of the plurality of rafters; and the thermal break comprising a break inner member contacting a first rafter exterior surface of the first rafter and a break outer member contacting a deck inner surface of the roof deck, said break inner member and said break outer member bounding a thermal air break therebetween.

2. The system of claim 1 wherein the first rafter is adjacent a second rafter of the plurality of rafters, the first and second rafters bounding a rafter bay therebetween, and further comprising a rafter bay baffle received in said rafter bay and having a plurality of projections contacting said deck inner surface and bounding a plurality of air spaces.

3. The system of claim 2 wherein said first rafter has a longitudinal dimension and said thermal break has a break thickness in a direction perpendicular to the longitudinal dimension equal to a baffle thickness of said rafter bay baffle in a direction perpendicular to the longitudinal dimension.

4. The system of claim 2 wherein said rafter bay baffle is located between said deck inner surface and an insulation layer, said baffle bounding a space between an outer surface of said baffle and said deck inner surface.

5. The system of claim 2 further comprising a baffle holder coupled to said first rafter and extending from said first rafter into said rafter bay to hold said baffle.

6. The system of claim 1 further comprising a baffle holder received over said thermal break and having an arm extending into a rafter bay between said first rafter and a second rafter of the plurality of rafters.

7. The system of claim 6 wherein said arm supports a baffle in said rafter bay, said baffle bounding a space between an insulation layer and said deck inner surface.

8. The system of claim 6 further comprising a second baffle holder coupled to said second rafter, said second baffle holder comprising a second arm extending into said rafter bay, said first arm and said second arm supporting said baffle in said rafter bay.

9. The system of claim 6 wherein said baffle holder is connected to said thermal break by a friction fit.

10. The system of claim 1 wherein said thermal break comprises a plurality of support members between said break inner member and said break outer member such that said thermal air break comprises a plurality of thermal air breaks bounded by said break inner member, said break outer member and said plurality of support members, said plurality of thermal air breaks providing fluid communication between a first rafter bay on a first longitudinal side of said first rafter and a second rafter bay on a second longitudinal side of said rafter.

11. The system of claim 10 further comprising a first baffle bounding a first space in said first rafter bay and a second baffle bounding a second space in said second rafter bay, said plurality of thermal air breaks providing fluid communication between said first space and said second space.

12. A method for use in constructing a roof system comprising:

locating a thermal break between a roof deck and a first rafter of a plurality of rafters configured to support the roof deck;

a break inner member of the thermal break contacting a first rafter exterior surface of the first rafter; and a break outer member of the thermal break contacting a deck inner surface of the roof deck, the break inner member and the break outer member bounding a thermal air break therebetween.

13. The method of claim 12 further comprising locating a rafter bay baffle in a rafter bay between the first rafter and a second rafter of the plurality of rafters, the rafter bay baffle having a plurality of projections contacting the deck inner surface and bounding a plurality of air spaces.

14. The method of claim 13 further comprising coupling a baffle holder to the first rafter and extending the baffle holder said rafter bay to hold the baffle.

15. The method of claim 1 further comprising receiving the thermal break in a cavity of a baffle holder to connect the baffle holder to the thermal break and extending an arm of the baffle holder into a rafter bay between the first rafter and a second rafter of the plurality of rafters.

16. The method of claim 15 wherein the arm supports a baffle in the rafter bay, and the baffle bounding a space between an insulation layer and the deck inner surface.

17. The method of claim 13 further comprising connecting a baffle holder to the thermal break by a friction fit.

18. The method of claim 12 the thermal break comprises a plurality of support members between the break inner member and the break outer member such that the thermal air break comprises a plurality of thermal air breaks bounded by said break inner member, said break outer member and said plurality of support members, and further comprising providing fluid communication between a first rafter bay on a first longitudinal side of the first rafter and a second rafter bay on a second longitudinal side of said rafter through the plurality of thermal air breaks.

19. The method of claim 18 further comprising a first baffle bounding a first space in the first rafter bay and a second baffle bounding a second space in the second rafter bay, the plurality of thermal air breaks providing fluid communication between the first space and the second space.

20. A system for use in constructing a roof comprising:

a roof rafter;

a thermal break connected to the roof rafter by a baffle holder; and the thermal break comprising a break inner member and a break outer member connected by support members and bounding a plurality of spaces to provide fluid communication between opposite surfaces of said rafter and to provide a thermal interruption between said rafter and a roof deck when the roof deck contacts the thermal break; and the baffle holder comprising a plurality of legs bounding a cavity receiving the thermal break and having a plurality of arms extending in directions opposite to each other and substantially perpendicular to a longitudinal dimension of said thermal break to support a plurality of baffles in opposite rafter bays.

* * * * *